US005127240A

United States Patent [19]

Manini

[11] Patent Number: 5,127,240

[45] Date of Patent: Jul. 7, 1992

[54] MACHINE FOR THE PRODUCTION OF FINISHED KNITTED ARTICLES, OF THE TYPE OF TIGHTS OR PANTY-HOSE

[75] Inventor: Benito Manini, Florence, Italy

[73] Assignee: Lambda S.r.l., Florence, Italy

[21] Appl. No.: 564,058

[22] Filed: Aug. 7, 1990

[30] Foreign Application Priority Data

Aug. 10, 1989 [IT] Italy ..... 9506 A/89

[51] Int. Cl.[5] ..... D04B 9/46

[52] U.S. Cl. ..... 66/18; 66/34; 66/125 R

[58] Field of Search ..... 66/18, 25, 34, 125 R, 66/220

[56] References Cited

U.S. PATENT DOCUMENTS

| | | | |
|---|---|---|---|
| 991,711 | 5/1911 | Franck | 66/34 |
| 1,007,494 | 10/1911 | Scott | 66/34 |
| 1,081,179 | 12/1913 | Wildman | 66/34 |
| 1,738,787 | 12/1929 | Miller | 66/34 |
| 1,843,412 | 2/1932 | Barratt | 66/18 |
| 4,689,971 | 9/1987 | Conti et al. | 66/26 |
| 4,724,687 | 2/1988 | Gariboldi et al. | 66/125 R |

*Primary Examiner*—Werner H. Schroeder

*Assistant Examiner*—John J. Calvert

*Attorney, Agent, or Firm*—McGlew & Tuttle

[57] ABSTRACT

A knitting machine is provided for producing tubular articles based on two fixed bars of needles wherein rows are formed partly by the needles of one bar and partly by the needles of the other bar. A thread is provided which is displaced alternately in both directions along the bars. Cam rings are provided rotating in continuous motion and in opposite directions. Each of the cam rings including cams acting on one of the needle bars for providing trajectories of the needles of one of the two bars forming a limited angle, generally than 30°, relative to the trajectories of the corresponding needles of the other bar. The needles of the two bars are arranged offset and are controlled by the cams to provide the sliding movement necessary for the formation of the stitches of the tubular fabrics. Sliding movement is provided such that the hooks do not cross over during the formation of stitches such that it is possible to work on both bars simultaneously. For joining the fabrics of the two bars, the needles of the two bars are caused to carry out sliding movements greater than the normal stitch formation sliding movement. In this way, the needles do cross one another and engage the same thread, during the crossover.

14 Claims, 8 Drawing Sheets

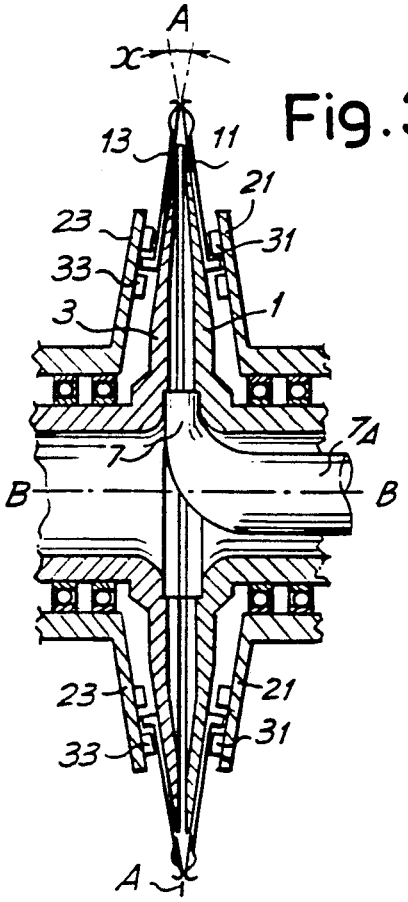
Fig. 3
Fig. 4
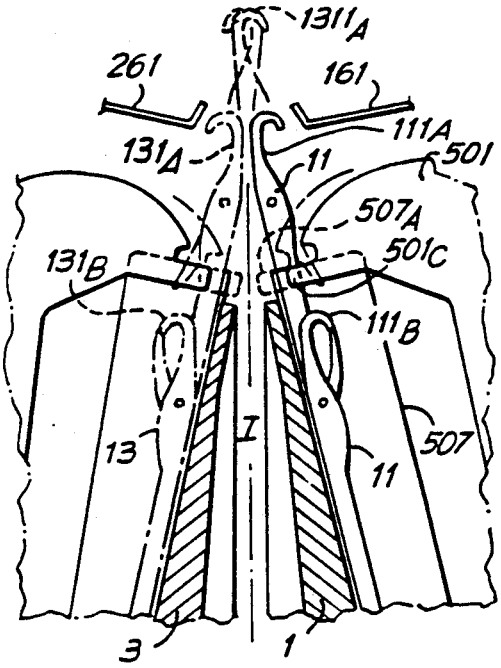
Fig. 6
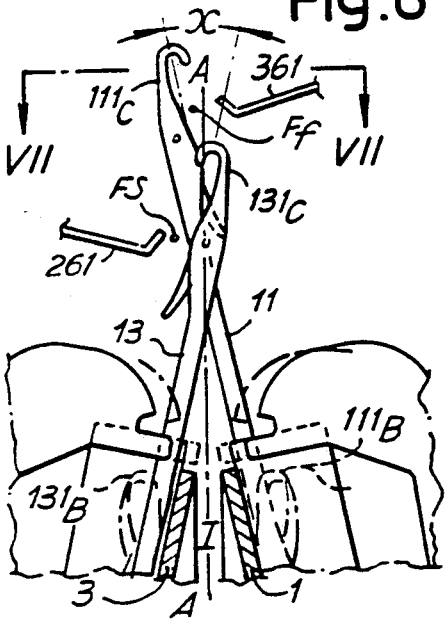
Fig. 5
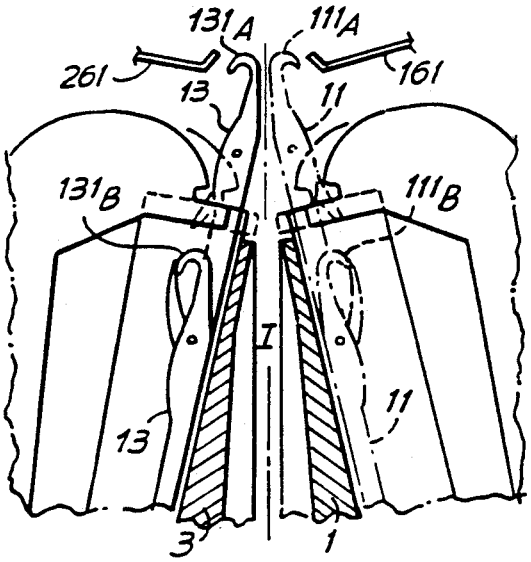

Fig. 9
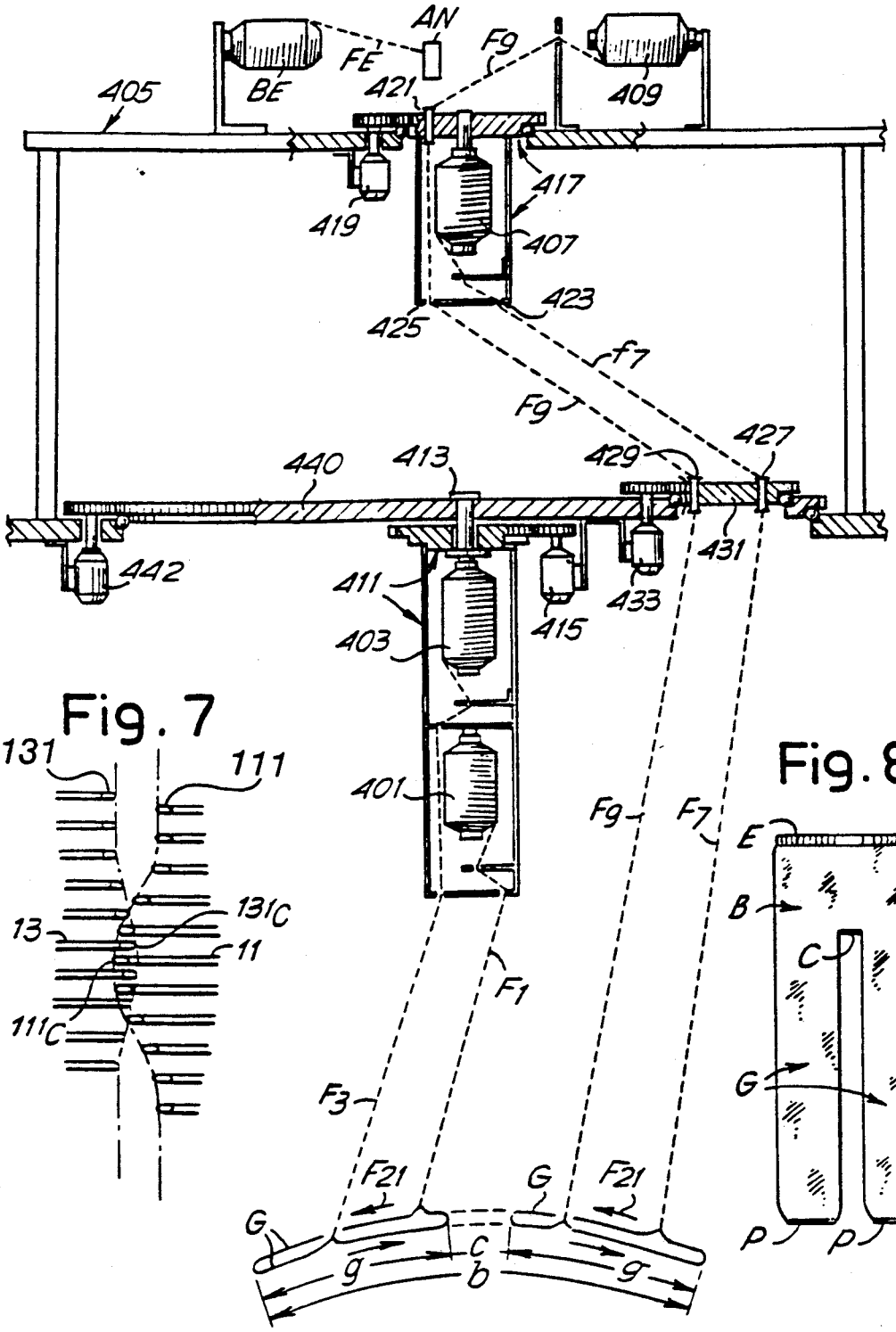
Fig. 7
Fig. 8
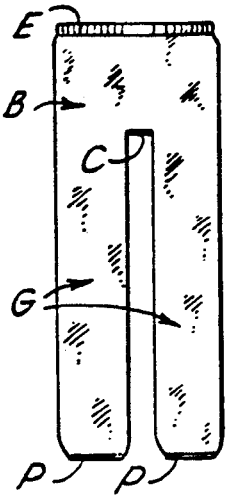

Fig.18
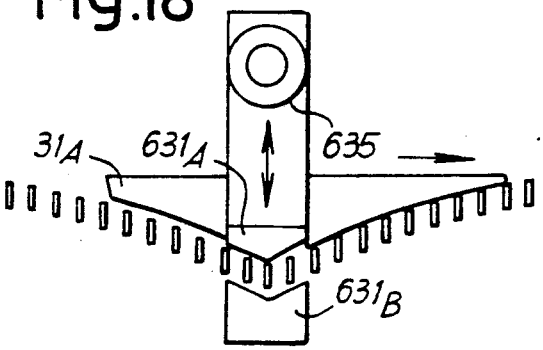
Fig.19
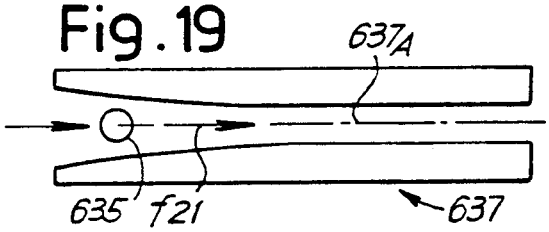
Fig.20
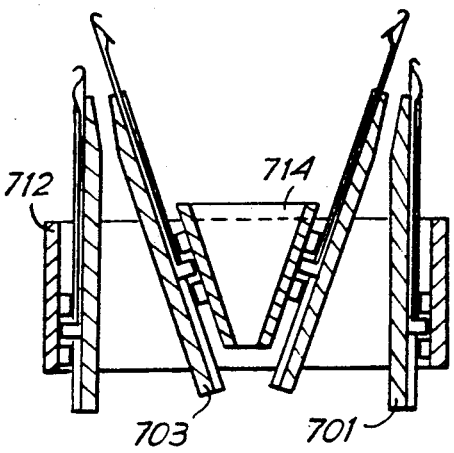
Fig.23
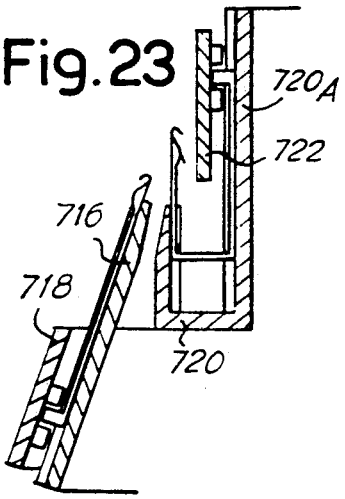
Fig.21
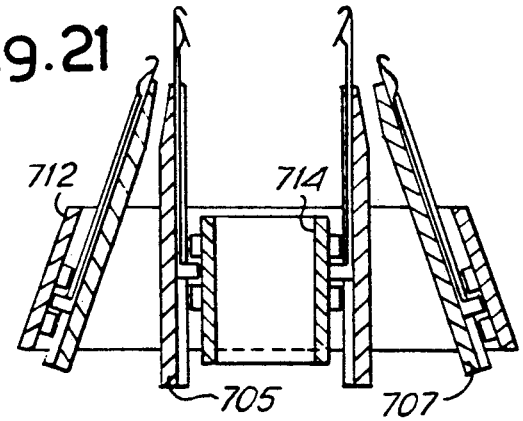
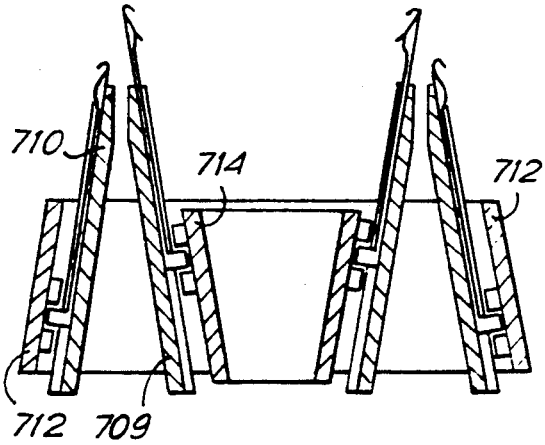
Fig.22

MACHINE FOR THE PRODUCTION OF FINISHED KNITTED ARTICLES, OF THE TYPE OF TIGHTS OR PANTY-HOSE

FIELD OF THE INVENTION

The invention relates to a knitting machine having two fixed bars of needles for the production of tubular articles with rows formed partly by the needles of one bar and partly by the needles of the other bar, at least one thread being displaced alternately in both directions along the bars together with cam rings rotating in continuous motion and in opposite directions, the tubular articles coming from the machine being closed at one end by a thread engaged simultaneously by the needles of the two bars. Machines of this type have been disclosed—in general terms—in prior patents, which are cited in the course of the present description.

SUMMARY OF THE INVENTION

According to the invention:

the trajectories of the needles of one of the two bars form a limited angle (generally less than 30°) relative to the trajectories of substantially corresponding needles of the other bar;

the needles of the two bars—which are arranged offset—are controlled, for the purposes of the sliding movements necessary for the formation of the stitches of the tubular fabrics, in a manner such that the hooks thereof do not cross over and such as to be able to work on both bars simultaneously; and in order to join the fabrics of the two bars, the needles of the two bars are controlled to carry out sliding movements greater than those necessary for the formation of the stitches, in order to cross one another and engage the same thread simultaneously with the needles of both bars.

In order to join the fabrics of the two bars the needles of a first bar can be caused to perform a sliding movement greater than that which the needles of the other bar are caused to perform, as a result of which the hooks of the needles of the first bar engage the thread and, in lowering, also position it in front of the hooks of the needles of the other bar in order to be gripped by the latter, which can be fed with a supplementary thread for forming the connecting stitches.

In a possible embodiment, the two fixed bars can be formed by two coaxial and opposing, substantially discoidal structures on which the bars are developed along external conical surfaces and the needles along the generating lines slide away from the vertex in order to grip the thread; the article or articles being formed developing in the interspace between said two substantially discoidal structures. Between the needles, sinkers can be provided which are movable to carry out an expedient displacement towards the interspace for the article being formed. A suction duct can be developed coaxially to one of the two discoidal structures in order to tension the article and transport the latter away by means of a current of aspirated air.

According to another possible embodiment, the two fixed bars can be formed by two needle beds, one inside the other, and at least one of them which is of frustoconical development, having the small angle at the vertex. The outer bed possesses the needles arranged on the outer surface surrounded by a cam ring, and having the hocks of the needles on the outside, while the inner bed possesses the needles arranged on the inner surface, surrounding a cam ring, and having the hooks of the needles on the inside. The outer needle bed can be frustoconical and the inner bed cylindrical, or the outer needle bed can be cylindrical and the inner bed frustoconical, or alternatively both the beds can be frustoconical.

The machine may comprise, on each of the two counter-rotating cam rings, a plurality of sets of cams, each of which sets comprises one lowering cam and two lifting cams for lifting movements of two extents, which are activated alternately.

A machine of the abovementioned type, for the formation of articles having two tubular legs and an adjoining body, may carry out the formation of each leg with at least two threads coming from an equal number of thread guides of a separate device which performs one revolution upon itself for each complete row of the article; the machine is likewise able to form the body with a number of threads equal to the total of those used for the two legs. To this end, the first of said devices is displaced—in addition to a revolution about itself—about the other of said devices in order to perform one revolution for each formation of a complete row, during the formation of the body with the same threads or with threads corresponding to those of the two legs. Said first device can be mounted in a seating for eccentric rotation in a plate capable of rotating coaxially or otherwise about said other device and actuated to rotate during the formation of the body.

In order to vary the length of the stitches, at least one member may be provided having a bell cam which is angularly movable coaxially to the counter-rotating devices of the cams, having a tappet member which is axially movable and acts on a linkage for regulating the cams forming stitches on said counter-rotating devices.

Alternatively, and for the same purpose, at least one member may be provided having an impelling channel and capable of being displaced and acting on a frictioned slide which forms at least the lower active part of the stitch-forming cam and has a head capable of being controlled by the sides of the channel through which it passes during the rotation of the associated counterrotating device.

BRIEF DESCRIPTION OF THE DRAWINGS

The invention will be better understood by following the description and the attached drawing, which shows a practical, non-limiting illustrative embodiment of said invention. In the drawing:

FIG. 3 shows a general diagrammatic view in section along a diametral plane;

FIGS. 4, 5 and 6 show an enlarged detail of the working zone of the needles, with the needles in different attitudes;

FIG. 7 is a view along VII—VII in FIG. 6;

FIG. 8 shows diagrammatically an article of the type of tights or panty-hose;

FIGS. 9, 10, 11 and 12 show a four-drop yarn feeder assembly, in a sectional view and in plan view, at different working, stages;

FIGS. 18 and 19 show functional diagrams of a different embodiment of said controls; and FIGS. 20, 21, 22 and 23 show diagrams of modified embodiments.

DETAILED DESCRIPTION OF THE PREFERRED EMBODIMENT

Figure 1:
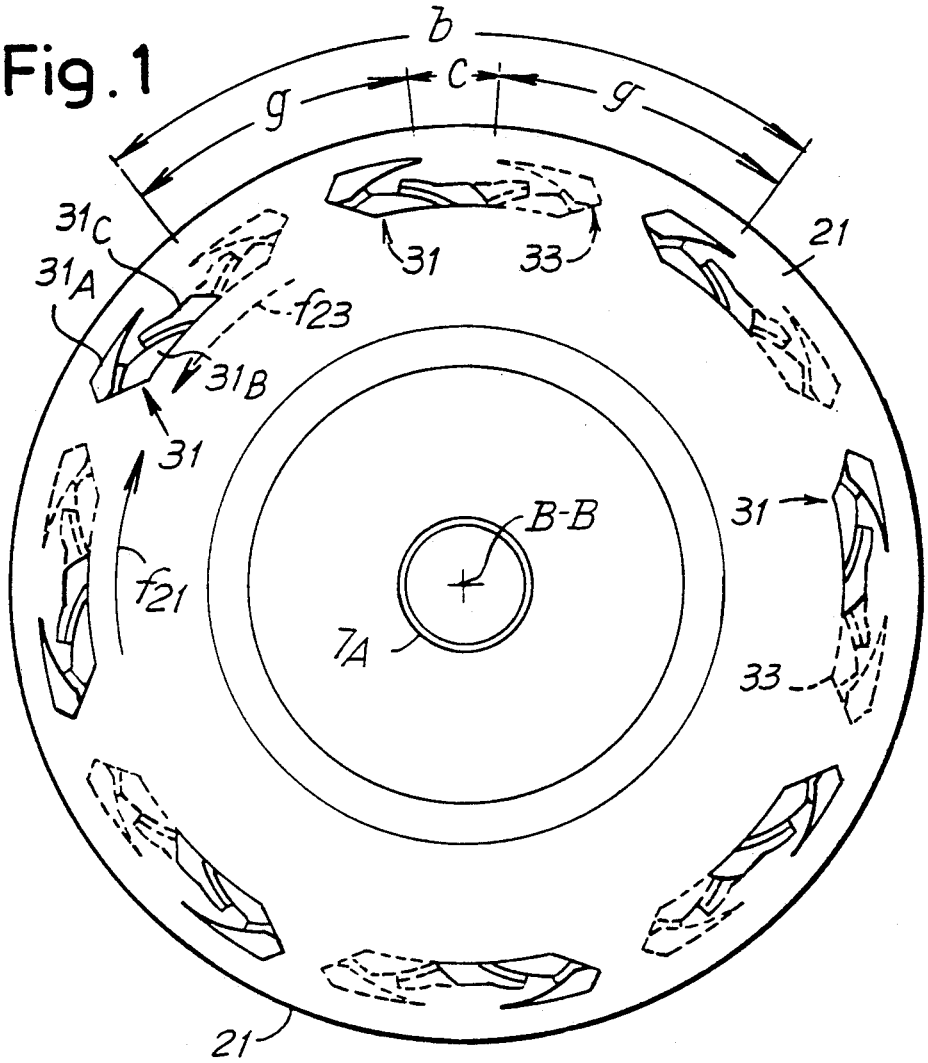
FIGS. 1 and 2 show axial views of two counterrotating cam rings (one shown transparently) in two different relative positions.
Figure 2:
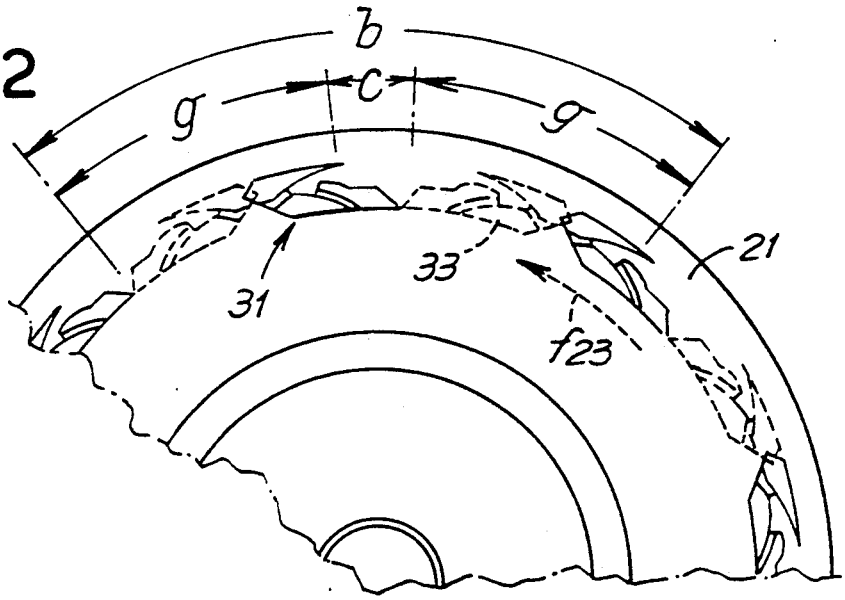
Figure 10:
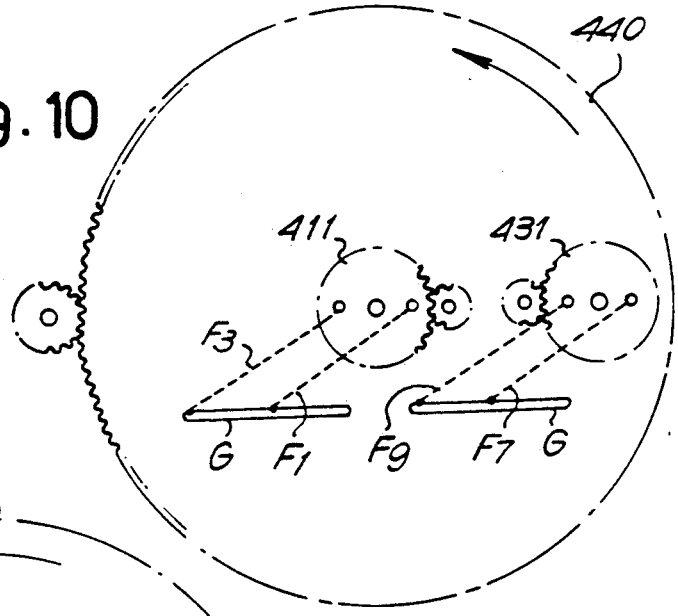
Figure 11:
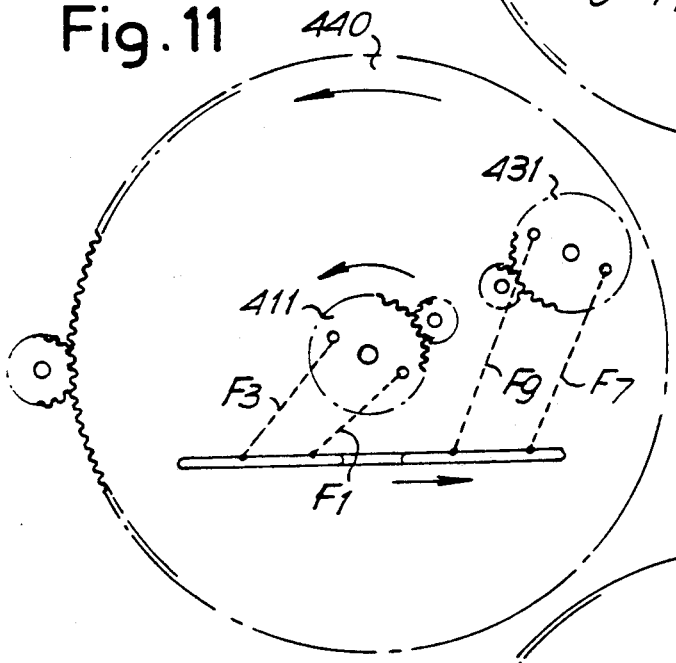
Figure 12:
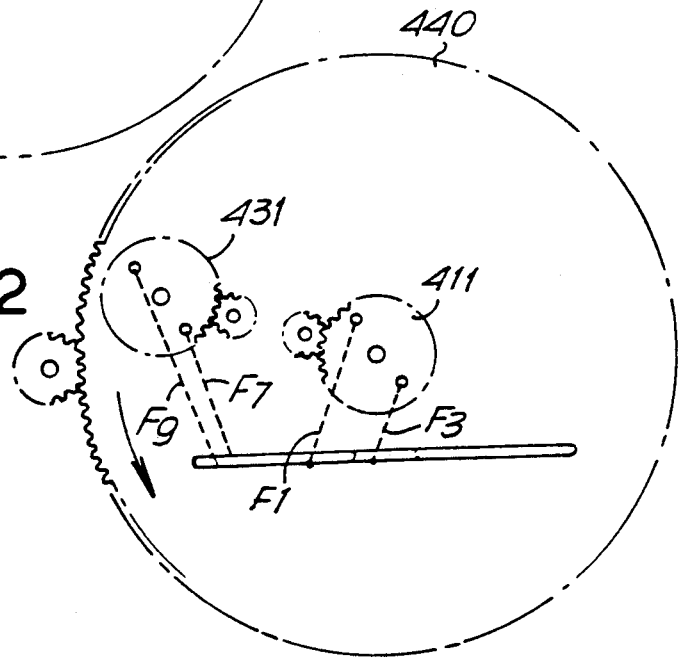

In accordance with what is shown in the example of FIGS. 1 to 7, a machine for producing articles of the type of so-called tights or panty-hose having two legs and a body, in a single item (or even in two items simultaneously), comprises two substantially discoidal fixed structures designated 1 and 3, which are substantially symmetrical relative to the plane A—A (See FIG. 3) and are set at a limited distance one from the other in order to leave between them an interspace I (see FIGS. 4, 5 and 6) where the article M being formed develops, apart from further temporary movements away for various purposes Each of the substantially discoidal structures 1, 3 possesses a bed, that is to say a bar of needles contained within a substantially conical surface portion having an axis B—B orthogonal to the axis A—A, each of these frustoconical surfaces having a very large angle at the vertex, so that two generating lines corresponding to the two frustoconical surfaces form between them a very restricted angle x. The two bars form sliding seats for the needles along the generating lines of the respective frustoconical surfaces; 11 designates the needles of the bar having a frustoconical sector formed by the discoidal structure 1, and 13 designates the needles of the bar having a frustoconical sector formed by the discoidal structure 3; the needles 11 and 13 slide longitudinally in the respective sliding seats of the bars, with trajectories which cross—without mutual interference—at mutual inclination corresponding to the angle x; this angle is an angle of limited size, usually less than 30°, for the reasons indicated below. 7 designates a suction port developed by a slot which extends in the working zone of the two bars for the needles 11 and 13, and said port 7 is prolonged to form a suction duct 7A coaxial to the axis B—B of the substantially discoidal structures 1 and 3, in order to tension the article during the formation and in order to remove it by pneumatic conveying after the formation of said article. In a simplified and probably more expedient solution, provision is made for the formation of a single article of the type of a pair of tights on each machine, and in this case an arc of needles b is provided, whose extension corresponds to the need to form a body and the associated elastic belt; this arc b is formed by two symmetrical arcs g which comprise the needles for the formation of the legs, and by an intermediate arc c which is intended to create the so-called "crutch" zone for the connection between the fabrics of the two legs G and for the subsequent forming of the body by means of the needles of the entire arc b. The arc b can be displaced relative to the vertical diametral plane, or centered relative thereto.

FIG. 8 shows a diagrammatic drawing of a pair of tights or panty-hose to be formed with the needles of the arc b, in a manner such that the two legs G are formed in alignment with the arcs of needles g, starting from the toes P which are closed, as far as the crutch zone C which is initially formed by the needles of the arc c, and then to form the body B with all the needles of the arc b as far as the formation of the elastic border E, with its appropriate threading of elastic or the like. Each of the needle bars which is fixed is associated with a cam ring, generally designated 21 and 23 respectively for the bars contained within the structures 1 and 3 of the needles 11 and 13; the two cam rings 21 and 23 have a substantially frustoconical development with axis B—B, analogously to the development of the two discoidal structures 1 and 3 forming the two frustoconical bars. The two cam rings 21 and 23 are rotating in opposite directions about the axis B—B. In particular, the cam ring 21 can be rotating according to the arrow f21 and the cam ring 23 can be rotating in the opposite direction to the arrow f21. Each cam ring possesses a certain number of cam sets—31 and 33 respectively—for controlling the needles of the arc b in the direction in which the ring in question is moving. Each set of cams such as those 31 possesses one triangle cam 31A for lowering in the centripetal direction during the displacement in the direction of the arrow f21, and two lifting cams, 31B and 31C respectively, for selectively obtaining two different levels of lifting, the cam 31B causing a less extensive lifting and the cam 31C a greater lifting (in the centrifugal direction), the lowering for stitch formation always being undertaken by the triangle cam 31A. The cam sets such as the sets 31 and 33 are mutually spaced to permit the formation of successive rows of stitches with threads fed in the manner indicated below. During the formation of an article, the two cam rings 21 and 23, rotating continuously in opposite directions according to the arrow f21 and according to the arrow f23, cause the formation of a row of stitches with the needles 11 and with the needles 13, respectively, each time that a cam set 31 and cam set 33, respectively, pass over the respective needle bars. The formation of a continuous annular row on the two fronts of needles of the bars 1 and 3, that is to say on the two fronts of needles 11 and 13, is obtained in that the thread is supplied by hooked drawing members in a manner such as to be gripped by the needles 11 of the bar 1 when controlled by a cam set 31, while the subsequent transit in the opposite direction of the cam set 33 forms the second part of the row with the same thread, which is fed to the needles 13. Said continuously rotating devices which support the cam rings 21 and 23 also support drawing members suitable for engaging a thread which is supplied for the formation of the stitches in order to draw it in the direction of the arrow f21 and in the opposite direction so as to obtain alternating working on the two needle fronts. A principle of this type has already been illustrated in U.S. Pat. No. 4,689,971 (Italian Patent Application No. 9470 A/84, filed on Aug. 1, 1984 in the name of MERITEX S.r.l. and Paolo CONTI (granted as No. 1,198,894 of Dec. 21, 1988) and U.S. Pat. No. 4,724,687 (Italian) Patent Application No. 9527 A/85, filed on Nov. 28, 1985 in the name of Paolo CONTI and MERITEX S.r.l.) and Italian Patent Application No. 9357 A/89, filed on Mar. 7, 1989 in the name of LAMBDA S.r.l.

In comparison with the arrangements illustrated in the abovementioned patent documents, the arrangement according to the invention permits a much more extensive possibility for working and hence a greater speed of working than do the abovementioned patent documents. In fact, the abovementioned patent documents provided for the formation of one or two rows of stitches on one bar, then the passage of the thread or threads to the other bar and the formation of one or two rows of stitches on said other bar and so on, with the thread or threads passing from one bar to the other at the ends of the working arc of the needles. With the arrangement according to the invention, it is possible to work on both of the bars equally well, at the position of each working arc of the needles of the two bars, which needles can operate independently and even simultaneously; consequently, the number of drops functioning at any given time for the formation of that many rows of stitches in a working arc of the two bars can be increased, and it is possible to feed threads to, and work on, both of the two bars simultaneously, with a substantial increase in productivity.

In order to achieve this, provision is made for the inclined arrangement of the two fronts or beds of needles, with the possibility for crossing of said needles and the possibility of forming stitches both independently on the needles of both bars and in combination between the needles of one bar and the corresponding needles of the other, in order to obtain a closure, that is to say a connection between the two working fronts of the two bars, and hence for the purposes of a connection of the two fabrics. With this arrangement, a row of stitches on one bar of needles,. for example on the bar of the needle bed, with needles 11, is obtained by implementing the lifting of said needles until the hooks 111 reach the position 111A, and then lowering the hooks of the same needles 11 into the position 111B for the formation of the stitch, making use of the cams 31B for lifting and 31A for lowering. Similarly, with the cam sets 33, the needles 13 are lifted until the raised position 131A of the hook 131 of the needles 13 is reached, and a lowering is carried out into the position 131B for the formation of the stitch, making use of the cams of the sets 33 which correspond to the cams 31B and 31A of the sets 31. It should be noted (cf., specifically FIGS. 4 and 5) that in the raised position of the hooks 111A and 131A, it is impossible for the thread presented to the hooks 111A also to be engaged by the hooks 131A, and vice versa, even when the needles 11 and 13 are lifted to the level 111A and 131A of the hooks, or actually when they are even partly crossed, as indicated at 1311A in FIG. 4; the needles of one of the bars do not interfere with those of the other bar because they are offset, as can be clearly seen in FIG. 7, while the simultaneous feeding of thread to the lifted hooks 111A and 131A excludes the possibility of a hook engaging the thread belonging to the hooks of the other bar. When the needles 11 and 13, respectively, are lowered from the position 111A into the position 111B, and from the position 131A into the position 131B, respectively, they form the stitches in the respective needle bars in order to create a tubular article (not shown) which develops in the interspace I between the two discoidal structures 1 and 3, growing in the centripetal direction towards the suction duct 7A. A drawing member 161 for the thread, supported by the cam ring 21, presents the thread to the hooks 111A in the lifted position of the needles 111. A drawing member 261 supported by the cam ring 23 presents a thread to the hooks 131A in the lifted position for the formation of the stitch when the hook has been lowered into the position 131B. When a thread drawn by a drawing member 161 arrives at the bottom of the working arc, which can be an arc g or the arc b for the formation respectively of a leg or of the body, in the direction of the arrow f21, the thread is released by the drawing member which has drawn it and—as a result of the synchronization and phasing of the rotational movements of the two cam rings 21 and 23—it is gripped by a drawing member 261 in order to be supplied to the needles 13 when these are lifted with the hook in the position 131A. Thus the same thread, caught first by a member 161 and then by a drawing member 261, and so on, subsequently comes to form the contiguous rows of stitches, with helical development, on the two working fronts of the needles 11 and 13; contiguous helical rows are formed in a number which is equal to the number of threads fed to said working arc. At the moment when the cams of a set 31 and cams of a set 33 cross over in the counter-rotating movement of the two cam rings 21 and 23, no interference occurs between the needles of one bar and the needles of the other bar, although they are simultaneously forming the stitch with their own needles.

As already stated, at for example the toes P or at the closure of the crutch C, a connection has to be made between the fabrics of the two bars, and in particular the two fabrics must be joined from the start to produce a closed toe P at the start of the formation of an article, or, respectively, to start, on the front of the needles of the arc c, the formation of the connecting fabric in the crutch zone C before starting the formation of the body B. In order to achieve this, according to the invention, provision is made for lifting movements of the needles which are greater than those previously described and which result in the position of the hooks indicated at 111A and at 131A; these greater lifting movements increase the degree of cross-over of the needles, to reach a state in which a thread presented to the hooks of one bar is also engaged by the hooks of the needles of the other bar. As can be seen, for example and in detail, in FIG. 6, provision can be made for performing a lifting movement of the needles 11 such as to bring the hook 111 of the needles 11 into a greatly raised position 111C; this can be achieved by actuating the cam 31C of the cam set 31, as a result of which a lifting movement of the needles 11 is performed in the centrifugal direction until the hook 111 is brought into the position 111C, or alternatively by means of other selection cams. Correspondingly—in order to effect the connection of the two fabrics, for example at the toes P or at the position of the crutch line C—the needles 13 are also caused to lift to a greater extent, for example until the hook 131 is brought into the position 131 C, which is higher than the position 131 A but at a lower level in the radial direction as compared with the position 111C of the hooks 111 of the needles 11 of the other bar. During these working stages whose aim is the connection of the two fabrics formed by the two bars of needles 11 and 13, a thread drawing member, designated 361 and situated at a level higher than that of the drawing members 161 and 261, is brought into operation. This drawing member 361 for the thread Ff is capable of supplying the thread to the lifted hook in the position 111C of the needles 11. When the hook is lowered from position 111C (by means of the cam 31A) into the position 111B for the formation of the stich, it engages said thread Ff, drawn by the drawing member 361, and also carries it in front of the needle 13, that is to say in front of the hook 131C which has been lifted to a level such—although lower than the level of the hook in position 111C—as to receive the thread Ff in front of said hook in position 131C to form a stitch with the needles 11. In order to be able to form a stitch with the needles 13, in a subsequent stage the latter are supplied with an additional thread FS, which additional thread FS forms a stitch on the lowering of the hook 131 from the position 131C into the position 131B; the thread Ff already supplied by the hook 361 then remains connected to these stitches formed by the needles 13. Thus, in this manner, at least one line of stitches is obtained which are formed with the needles 11 and with the needles 13 lifted to the level of the hooks 111C and 131C; in other words, the formation of a stitch structure is ensured in which the two fabrics formed or to be formed by the needles 11 and 13 of the two bars are mutually connected, as is in fact necessary for the formation of the closed toes P and for the closure of the crutch line C. For the purposes of connection between these two fabrics, provision is made—as a fundamental criterion—for increasing the lifting of the needles, and feeding the threads under such conditions that they can be gripped by the two hooks which have reached the crossed-over position 111C and 131C respectively. In order to work the connecting rows between the two fabrics—as at the toes P and in the crutch C—at least one of the threads for the connection is presented in a raised position relative to the position of the threads carried by the drawing members 161 and 261, specifically in order to achieve the gripping by both of the hooks 111 and 131, with the increase in lifting and hence in crossed-over attitude of the needles.

The arrangement illustrated in FIG. 3 and in various details of other Figures represents a particularly simple demonstration model which takes no account of the design requirements in order to illustrate the fundamental concept of the formation of the stitch; a more detailed structure is described subsequently. The structure is conceptually implemented by means of the two substantially discoidal structures 1 and 3, which form the two inclined bars which are developed along frustoconical surfaces in order to create the beds of needles along the arc b for the formation of an article of the type of a pair of tights or panty-hose, such as that in FIG. 8. For a convenient view of the working zone of the needles, the arc b can be inclined relative to the vertical (rather than being centered, as in the drawing), so that an operator positioned at the side can monitor the working of the machine. It is not impossible that, in positions which are symmetrical relative to the vertical diameter in the view shown by FIG. 1, two pairs of bars may be provided along two arcs (which are analogous to the arc b) in order to carry out the simultaneous formation of two articles.

A description will now be given of a possible method of feeding the threads for the formation of the articles along the two arcs of needles g, and then along the arc b, for the formation of the legs G and subsequently of the body B.

Referring to FIGS. 9 to 12, and also with reference to the recent patent documents mentioned above in which a similar feed system is provided, in order to feed the threads, for example four threads, to one arc of needles b, a structure such as that indicated in FIG. 9 is provided. The two reels of yarn 401 and 403 are provided in a coaxial and central position of a feed set 405—generically indicated by the arc of needles b—and one pair of reels 407 and 409 for two other threads, the threads being respectively indicated by F1, F3, F7 and F9. The two reels 401 and 403 are carried by a device 411 which is rotating about the axis 413 under the action, for example, of a motor actuator 415. Said device 411 is capable of rotating through one revolution during the formation of a row of stitches along the arc g shown on the left in the drawing by the needles 11 in one direction, and hence in the opposite direction with the needles 13. A second device 417 is caused to rotate by a motor actuator 419 in order to rotate coaxially with the device 411 and hence coaxially with the shaft 413 of this device 411, again in order to perform one rotation during the formation of a row of stitches by the needles of the two needle bars 11 and 13 at the position of the arc of needles g which is shown on the right in FIG. 9; the device 417 carries the reel 407 and also carries an eccentric thread-guide 421 for the thread coming from the reel 409 carried by the structure 405. The two threads F7 and F9 coming from the two reels 407 and 409 pass through thread guides 423 and 425 which are equidistant relative to the axis of rotation of the device 417 which carries said thread guides; moreover, the threads F7 and F9 pass through two thread guides 427 and 429 carried by a third device 431 which can be caused to rotate by a motor actuator 433, which causes the device 431 to perform one rotation, as does the device 417, during the formation of a row by the threads F7 and F9. With the arrangement hitherto described for feeding the threads F1, F3, F7 and F9, the two tubular structures G of a pair of tights or panty-hose can be formed along the two arcs of needles g by the needles 11 and 13. Each of the two threads F3 and F1, when—having formed stitches with the needles 11—it reaches the end of the arc g in the direction of the arrow f21, is released by the drawing member such as the member 161 which has drawn it, and is gripped by a drawing member 261 and drawn in the opposite direction to the arrow f21 in order to form the row with the needles 13. Similarly, each of the threads F9 and F7, when it arrives at the bottom of the arc of needles 11 in the direction of the arrow f21 by being drawn by a drawing member such as the member 161, is released thereby and is gripped by a drawing member 261 for the formation of stitches with the needles 13 in the opposite direction to the arrow f21, and so on.

Figure 13:
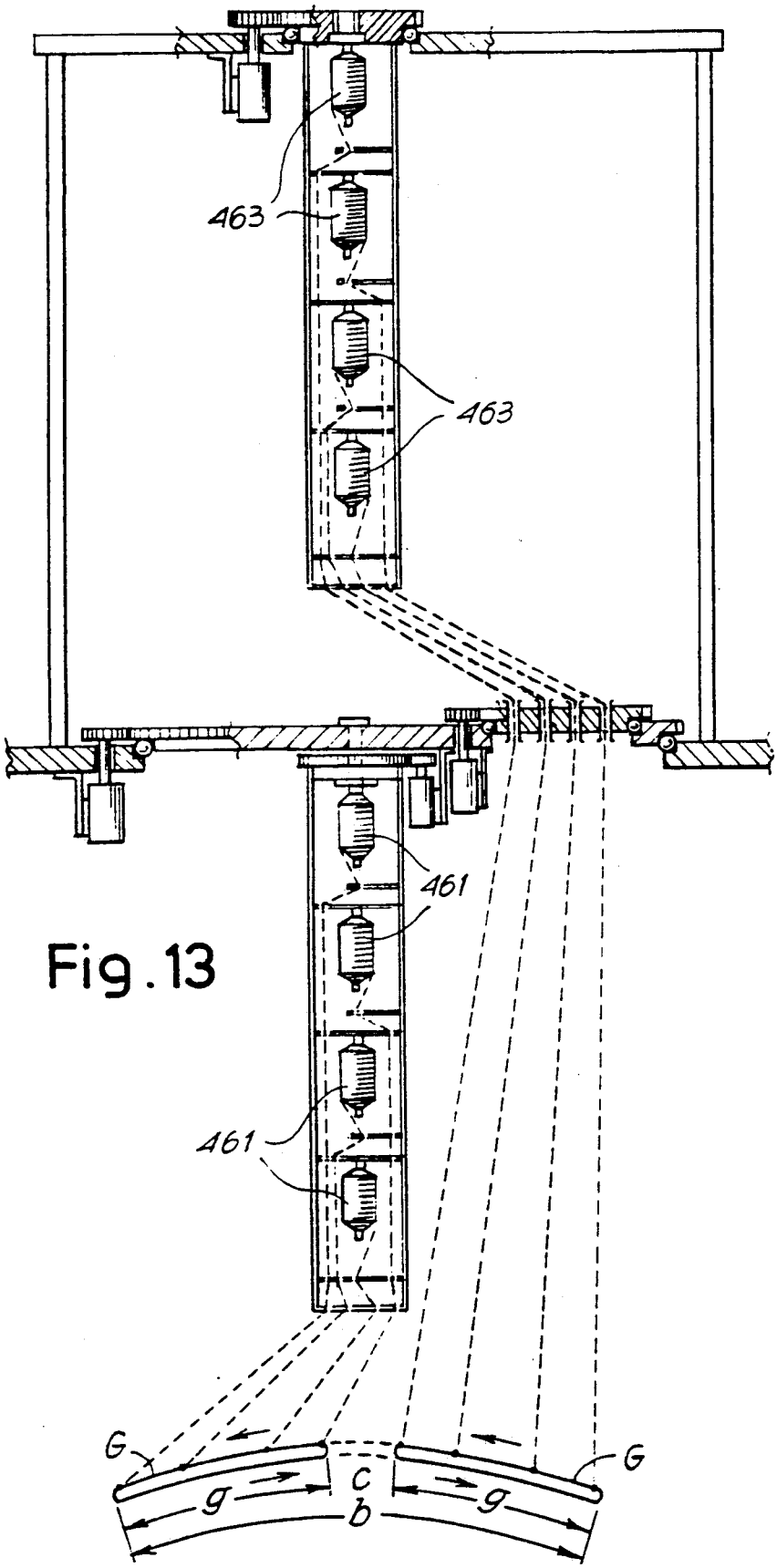
FIG. 13 shows a variant of FIG. 9, for eight drops.

It should be noted that each of the two arcs of needles c can also be fed with a number of threads greater than two, as is illustrated for example in FIG. 13, where an arrangement is shown which provides—in order to form the legs G—the feeding of four threads instead of two threads, with the presence of four reels instead of two reels as shown in FIG. 9. In FIG. 13, four reels 461 replace the two reels 401 and 403, and four reels 463 replace the two reels 407 and 409, and said reels 463 are arranged coaxially instead of in two mutually orthogonal positions like the reels 407 and 409, but the two arrangements can be used indiscriminately in FIG. 9 and in FIG. 13. It appears advantageous to use an even number of yarn feeds, that is to say yarn drops, for the formation of the legs G along the arcs g of needles, when use is made of two types of yarn having contrary directions of twist, which are well known in the industry for the production of women's stockings, and which are designated by the letters "S" and "Z" signify the two direction of the twists; with these types of yarn, which are alternated to form the even and odd rows respectively, elastic articles are obtained which do not tend to twist since they are held level by the compensatory effects of the elastic stresses in one direction and in the other direction exerted by the two types of yarn; this is the reason why it is convenient to use an even number of feeds, and hence an equal number of yarns of the abovementioned two types "S" and "Z".

These feeds using two plus two yarns, such as the yarns F1, F3, F7 and F9 (FIGS. 9 to 12) or four plus four yarns as shown in FIG. 13, can be used to form the portions G of the article, both of which are tubular (FIG. 10) When it is necessary to proceed from the formation of two tubular articles G to the formation of a body B (FIGS. 11 and 12) on an arc of needles b which comprises the arc c and the two arcs g, it is necessary to modify the feeding of the yarns, maintaining a number of drops which is equal to its sum of the yarn drops used for the formation of the two tubular articles G. For the formation of the body B, it is necessary in other words to maintain the same successive arrangement of the threads along the two bars, and hence it is necessary for the threads F3, F1, F9 and F7 to be fed to the needles 11, in the direction f21 as far as the end of the front of the arc b, the threads then gradually being passed from the front of the needles 11 to the front of the needles 13, always in the same sequence, F3, F1, F9 and F7. To achieve this, the structure previously described with reference to FIG. 9 is modified by means of an arrangement which comprises the performance of a further movement by the device 431 It is in fact arranged (FIGS. 9 to 12) that the device 431 is placed on a platform or plate 440 which rotates relative to the structure 405 in accordance with an axis which coincides with the axis of the device 411 and of the device 417; 442 designates a motor actuator which serves to control the plate 440 at the appropriate time in order to cause the latter to perform a rotation of one turn for each formation of two partial ranks by the needles 11 and then by the needles 13 along the arc g for the formation of the article in the zone of the body B. When the machine is to begin formation of the single article of the body, the actuator 442 intervenes and causes the plate 440 to perform a revolution, driving the device 431, which in turn performs a revolution for each revolution of the plate 440. Both devices 411 and 431, and the plate 440, thus perform one revolution for each formation of complete rows along the arc b by the needles 11 and then 13, and so on, for the formation of the body B. With this arrangement, a regular feeding of the various threads to the article being formed is assured, so as to produce half a row on one bar and half a row on the other bar, the direction of movement of the working zone of the needles being inverted, and each row being formed by the same thread worked first by the needles 11 and then by the needles 13, and so on. In the case illustrated, with four threads F3, F1, F9 and F7, four rows of stitches which are spiral, that is to say helical, are obtained for each to-and-fro travel of the working zone of the needles between the ends of the arc g. With an arrangement such as that in FIG. 13 even more rows can be obtained, such as eight rows of stitches for each to-and-fro working cycle between the two ends of the arc g.

When the belt E is to be formed with the presence of an elastic thread FE, this thread FE, supplied by a reel BE, is knotted for example to the thread F9 by means of a tying machine AN of type known per se.

In each case, for the working of the body along the arc b, a number of rows is obtained for each cycle which corresponds to the total number of rows which are formed for each working cycle along the arcs g.

Figure 16:
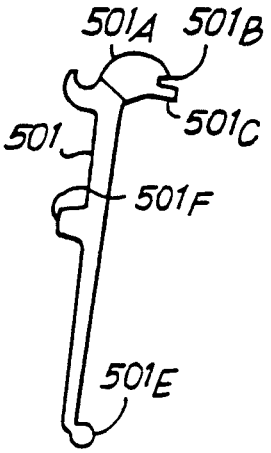
FIGS. 14, 15 and 16 show an alternative embodiment relative to FIGS. 4 to 6, and two details thereof.
Figure 14:
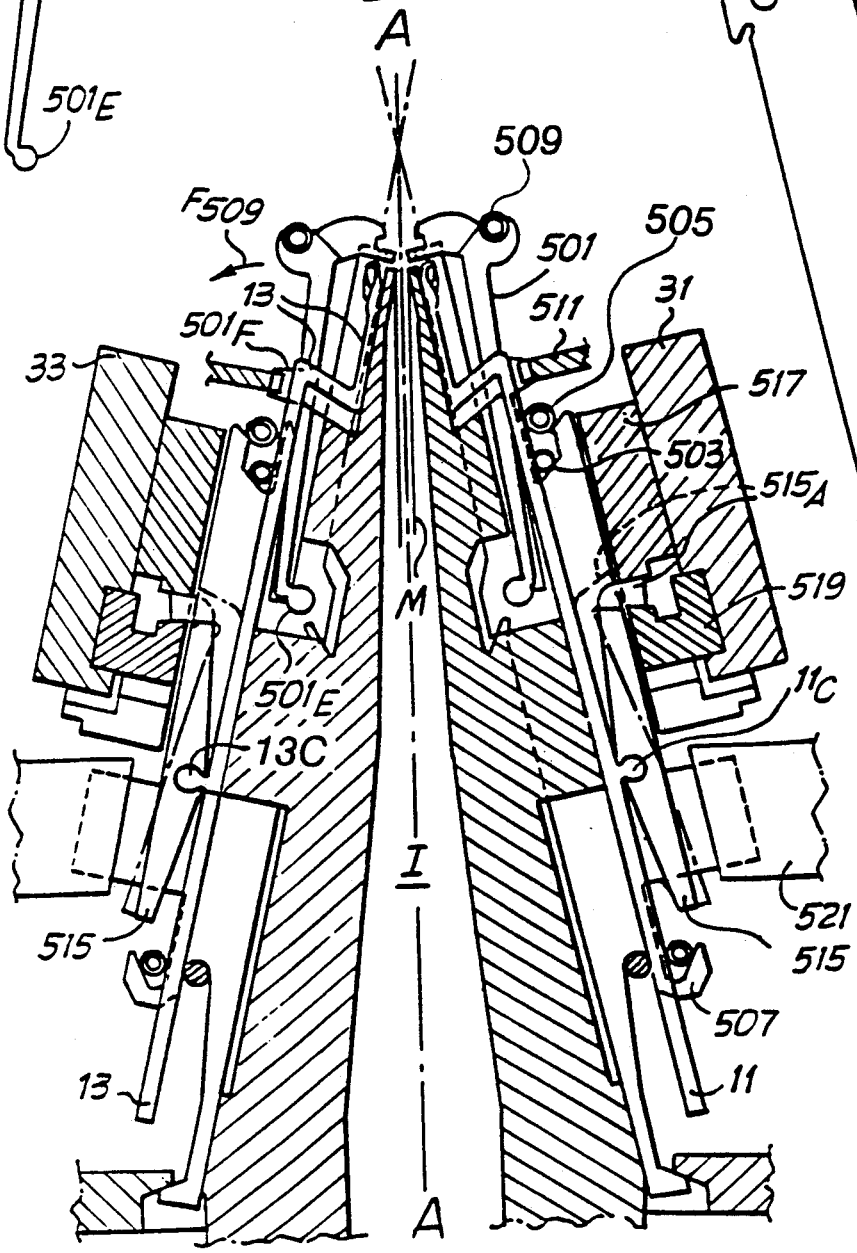

In FIGS. 14 and 16, provision is made for each of the discoidal structures 1 and 3, that is to say each of the needle beds, also to be equipped with corresponding sinkers.

According to this example, 501 designates a sinker whose end 501A is shaped to form a hook 501B and a support surface 501C for the stitch; the sinker is to be displaced towards the interspace I (where the fabric M being formed develops with a centripetal progression) at the moment of formation of the stitches, in order to support them. The sinkers 501 are designed to oscillate about the respective articulations 501E. The needles 11 and 13 have a "Z"-shaped development for reasons of bulk, and are supported by annular springs 503 and 505, which act as wedges between the dorsal surfaces of the needles and correspondingly shaped inclined surfaces of the strips 507, which have the function of forming the sliding channels for the needles. The sinkers 501 are stressed in the direction away from the interspace I, that is to say in the direction of the arrow f509, by springs 509 which themselves are also of annular development like the springs 503 and 505, around the axis B—B of the machine; the stressing in the direction f509 by the spring 509 is due to the displaced reciprocal position of the plane of the spring 509 relative to the plane which contains the articulations 501E of the sinkers 501. A cam 511 acts against the elastic tendency of the sinkers 501 to move away in the direction f509 and acts on projections 501F of the sinkers to determine their advance and their temporary actuation during the formation of the stitch. In each case, the stitch is also supported on the end 507A of the fish-plates or strips 507 intended to form the sliding channels for the needles and embedded in the structures 1 and 3. Symmetrical arrangements are provided in respect of the beds of needles 11 and 13.

Figure 15:
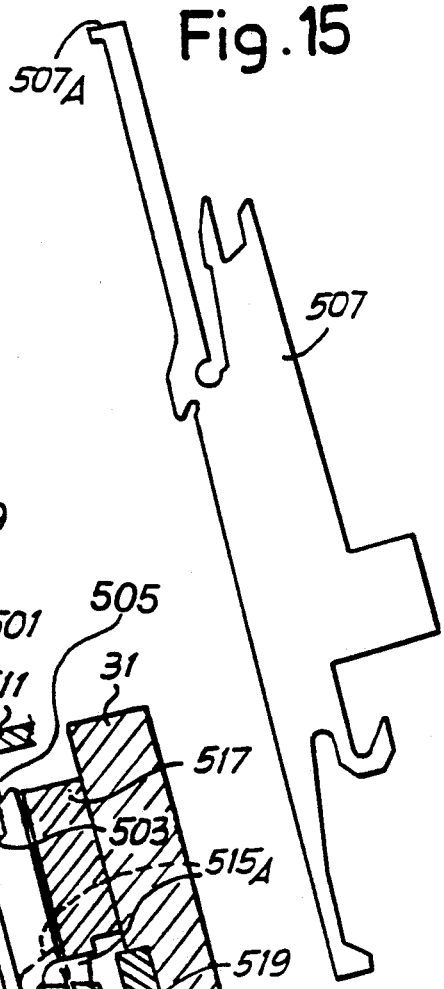

The needles 11 and 13 are controlled to slide, in order to form the stitch, with the differentiated lifting travels already described and with an arrangement which, in FIGS. 14 to 16, is more detailed than in the arrangement shown in the preceding Figures. According to this embodiment, each needle 11 and 13 forms an articulation head 11C and 13C which engages a rocker member 515 lying in the same diametral plane and moving in the same diametral plane as the respective needle, within the channel thereof, formed by the strips or fish-plates 507. Each rocker 515 possesses at one end a heel 515A which is capable of being controlled—for the sliding of the needle—by lifting and lowering cams generically designated 517 and 519; the cams 517 and 519 are intended to control the needles in a similar manner to that indicated in relation to the sets of cams 31 for the needles 11 and the sets of cams 33 for the needles 13 in the illustrative embodiment previously described. The heels 515 for the control of the needles are activated by the oscillation of the associated rockers 515 about the articulations 11C in order to cause the heels 515A to project so as to engage on the associated cams; for the purposes of this activation of the heels 515A, action is taken by selection pushers 521 which act on the rockers 515 from the opposite side of the articulation 11C relative to the heels 515A, specifically in order to cause them to project. Similar pushers or inclined cams are provided to act on the ends of the heels 515A in order to retract said heels into the channels and thus deactivate the control of the needles. Arrangements of this type are provided in other prior patent documents indicated above.

For the formation of an article of the type of a pair of tights or panty-hose, it is necessary, or at least expedient, to regulate the length of the stitches and hence to regulate the low position of the needles, that is to say the position designated 111B and 131B of the needles 11 and 13, in a manner such as to determine the length of the stitch being formed between the support plane formed by the surfaces 501C of the sinkers 501 and, respectively, by the ends 507A of the fish-plates 507 and the hook of the needle which has been lowered for the formation of the stitch. In order to achieve this, it is necessary to regulate the position of the cams which control the lowering of the needles and, in particular, of the cams such as that designated 5.7 in FIG. 14 or of the corresponding cams, namely of the triangle cams such as the cam 31A in the previous Figures. It is recalled that all these cams are mounted on two devices—such as the devices 21 and 23—which rotate in opposite directions in order to act on the needles 11 and 13 respectively of the two bars formed by the two discoidal structures 1 and 3. Means are therefore needed for regulating the position of the cams for lowering the needles, such as the cam 31A, of the sets of cams such as the sets 31 and 33 which have been briefly indicated. It may suffice to displace radially, relative to the axis B—B, only the triangle cams such as the cam 31A which corresponds functionally to the cam 517 in FIG. 14. This regulation needs to be capable of being effected even under conditions of rotation.

Figure 17:
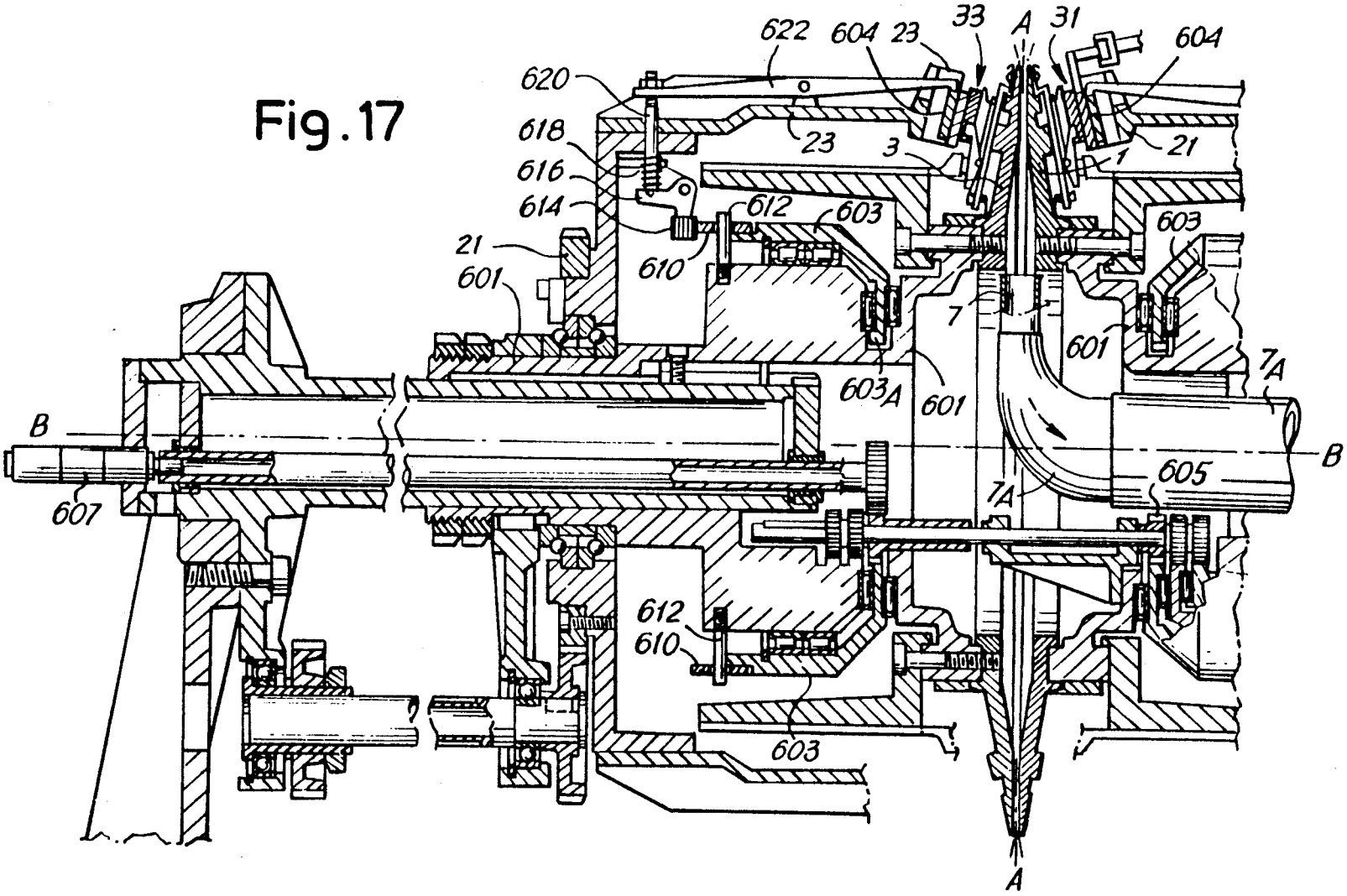
FIG. 17 shows, in lengthwise section, a possible embodiment of controls for regulating the length of the stitches during work.

With reference to the control adjusting the cams of the sets 31 or 33, according to an example of embodiment shown in FIG. 17, an arrangement is provided which is capable of effecting a number of different controls, but for the sake of simplicity is shown as being able to actuate only one control. The rotating device 23 which bears the cams 33 is mounted to rotate on a fixed structure 601 which bears the discoidal structure 1 of the needles 11 controlled by the sets of cams 31, and the discoidal structure 3 of the needles 13 controlled by the sets of cams 33. Mounted on the structure 601 are bell-shaped regulating members, one of which is designated 603 and is developed symmetrically relative to the axis B—B and in a manner such as to be able to be caused to rotate for the purposes of regulation about the axis B—B. The rotational control of the bell member 603 is achievable by means of a gearing 605 which engages with an internal toothed wheel 603A of the bell member 603 and can be controlled, for example, by means of an external control 607. Selective controls can be actuated by a plurality of coaxial and concentric bell members. The bell member 603 possesses an end profile shaped in the manner of a frontal cam which interacts with a corresponding profile of an annular member 610 capable of sliding movements parallel to the axis of the member 603, and hence parallel to the axis B—B, without being able to rotate as a result of the stop effected by means of pins 612 which engage the various annular members such as the member 610 via longitudinal slots which permit the axial sliding movements in the direction of the axis B—B. The annular members such as the member 610 form an outer profile which can act on one or more tappets 614 carried by corresponding rockers 616, which are stressed by opposing springs 618 in order to maintain contact with the frontal cam profile of the member 610; each rocker 616 is capable of acting on a pin 620 which controls a rocker 622 capable of acting on a block 604 which carries the cams of the set 31 and 33, or at least the cams 31A and 33A of said sets, in order to permit their sliding movements in the directions parallel to the generating lines of the frustoconical surface in which the bed of the needles 11 and 13, respectively, is formed. With this system, it is possible to regulate at any time, by means of the angular displacements of the bell members 603, the various sets of cams which are used for the formation of stitches, regulating their positions in order to vary the length of the stitches being formed.

According to another possible type of embodiment, the regulation of the stitch-forming cams in order to regulate the length of the stitches may be allocated to a positive control which acts on the cams 31 or 33, or at least on the triangle cams 31A or 33A for the lowering movement, against a frictional action which tends to maintain the cams in the position reached along a frictional sliding track which lies in the direction in which the cams are to move. In this case (cf. FIGS. 18 and 19) provision may be made for making a portion of the lowering cams movable such as the portion designated 631A and the associated counter-cam 631B, limited to the zone of maximum lowering of the lowering profile of the stitch-forming cams 31A. These cams or portions of cams are carried by frictioned slides on guides parallel to the direction of movement of said cams, with a relatively high degree of friction, and can each be equipped with a peg 635 which—during the rotation of each of the devices such as the counter-rotating devices 21 and 23—is capable of fitting into the broad end of a guide channel 637A formed by a member 637 carried by the fixed structure of the machine, but adjustable for the purposes of positioning, by means of a radial adjustment relative to the axis B—B, the narrow outlet part of the channel 637A. The adjustment may be parallel to itself or may be angular, with an articulation at a distance from the narrowed outlet aperture of the channel 637A; the adjustments are in any case very limited, of the order of tenths of a millimeter, in order to regulate the lowered position of the needles for the formation of the stitch and thus to vary the length of the stitch. With the rotation of the structure 1 or 3, each peg 635 carried by the frictioned slide of the cams 631A, 631B penetrates into the channel 637A at each revolution, and is guided by one or the other side of the latter in order to emerge at the narrow part of said channel 637A (travel in the direction of the arrow f21), in a manner such as to reach the desired position for said stitch-forming cams, which position can be corrected at each revolution by the adjustment of the member 637. It may be noted that the number of revolutions performed by the counter-rotating structures 21 and 23 is relatively limited, and hence the centrifugal effect exercised on the radial slides carrying the cams 631A and 631B is very limited; on the other hand, the masses of these slides for said cams 631A and 631B and the stressing of the heels of the needles on the cams are very limited; ultimately, there is no danger of a incidental movement. Moreover, members for controlling the position of the stitch-forming cams, such as the member 637, can be repeatedly present along the zone through which the cams and the pegs 635 travel, in order to ensure their continuous correction during their travel in the working zone facing the respective needle bars.

The invention can be actuated—in addition to actuation by means of machines of the types previously described, having substantially discoidal structures such as the structures 1 and 3 forming bars on bar arcs such as the arcs b for one article or for each article—also by means of other structures, still based on the principle of a restrictedly inclined orientation of the bars, and with crossing-over of the needles when the latter are lifted beyond the minimum height in order to grip the thread. FIGS. 20 to 22 show possible forms of embodiment of machines in which the needle bars have a circular development which is very close to the structure of a traditional needle cylinder, for the simultaneous formation of more than one article. For example (FIG. 20), it is possible to envisage producing a first, outer cylindrical needle bar 701 and a second, inner frustoconical needle bar 703, having the hooks of the needles of the first bar facing outwards and the hooks of the needles of the second bar facing inwards; the trajectories of the needles are such as to cross over and to cause the needles to cross over when they are lifted to a greater degree than the height which is sufficient for the gripping of the thread for the formation of the stitch, on the principles already previously indicated. It is also possible (FIG. 21) to provide for the formation of an inner cylindrical bar 705 having the hooks of the needles turned inwards and an outer frustoconical bar 707 having the hooks of the needles turned outwards. It is also possible to provide (FIG. 22) two frustoconical bars, an inner bar 709 and an outer bar 710, the bar 709 having the hooks of the needles oriented inwards and the bar 710 having the hooks of the needles oriented outwards. Counter-rotating cam rings are provided on the outside of the bars such as the bars 701, 707, 710, and on the inside of the bars such as the bars 703, 705 and 709; these counter-rotating cam rings are designated 712 and 714, respectively, in the three arrangements. In the three arrangements, the articles are formed along the annular interspaces which are defined between the two bars 701 and 703, or 705 and 707, or 709 and 710, respectively. These arrangements are more similar than the first example to the conventional machines, including machines of the type referred to in the patent documents previously mentioned.

FIG. 23 provides an arrangement similar to that in the preceding Figures (and especially in FIG. 21), in which a conical outer bar 716 is equipped with a cam ring 718, while an inner cylindrical bar 720 is developed with shaped needles and possesses a cylindrical portion 720A with which an outer cam ring 722 interacts for greater convenience of access.

The invention offers many advantages both from the textile point of view and from the structural point of view in the embodiment of the machines for the production of articles in general of tubular development, and in particular of articles of the type of tights or pantyhose having two legs and a body, achieving—with thread drops always in operation—a high rate of production combined with a considerable simplicity of construction and operation. These and other objects and advantages will be apparent to those skilled in the art.

It is understood that the drawing shows only an illustrative embodiment, given solely by way of a practical demonstration of the invention, said invention being capable of variation as to shapes and arrangements without thereby departing from the scope of the concept underlying said invention. The presence of any reference numbers in the appended claims is intended to facilitate reading of the claims with reference to the description and to the drawing, and does not restrict the scope of the protection represented by the claims.

I claim:

1. A knitting machine, comprising:

two fixed bars of needles for production of tubular articles with rows formed partly by needles of one bar and partly by needles of another bar;

thread displacement means for displacing alternately thread in both directions along said two fixed bars;

cam rings rotating in continuous motion in opposite directions, each cam ring acting on one of said two fixed bars of needles to provide trajectories of needles of said one of said two bars forming a limited angle, generally less than 30°, relative to trajectories of substantially corresponding needles of said another bar, needles of said two fixed bars being arranged offset and controlled by said cam rings in a manner such that hooks of said needles of one of said two bars do not cross over hooks of said corresponding needles and acting on said needles of said two fixed bars simultaneously, said cam rings including cam means for acting on selected needles to carry out a sliding movement greater than a sliding movement for formation of the stitches, to force selected needles to cross one another such that selected needles of both said two fixed bars engage the same thread upon crossing one another during the sliding movement greater than the sliding movement necessary for the formation of stitches.

2. The machine as claimed in claim 1 wherein—in order to joint the fabrics of the two bars—said cam means causes the needles of said one bar (1) to perform a sliding movement (111C) greater than that (131C) which the needles (13) of said another bar (3) are caused to perform, as a result of which lifted hooks (111C) of the needles of said one bar engage the thread and, in lowering, also position the thread in front of lifted hooks (131C) of said needles of said another bar in order to be gripped by said lifted hooks of said needles of said another bar, said lifted hooks of said needles of said another bar are fed with a supplementary thread (FS) for forming the connecting stitches.

3. The machines are claimed in claim 1, wherein the two fixed bars are formed by two coaxial and opposing, substantially discoidal structures (1, 3) on which the bars are developed along external conical surfaces and the needles (11, 13) along the generating lines slide away from a vertex in order to grip the thread; an article being formed developing in the interspace (I) between said two substantially discoidal structures.

4. The machine as claimed in claim 3, wherein between the needles, sinkers (509) are provided which are movable to carry out an expedient displacement towards the interspace (I) for the article being formed.

5. The machine as claimed in claim 3, wherein a suction duct (7A) is provided coaxially to one (1) of the two discoidal structures (1, 3) in order to tension and transport the article by means of a current of aspirated air.

6. The machine as claimed in claim 1, wherein the two fixed bars are formed by two needle beds (703–710) one inside the other, and at least one of which (703, 707, 710) is of frustoconical shape having the small angle at the vertex.

7. The machine as claimed in claim 6, wherein an outer of said needle beds possesses needles arranged on an outer surface surrounded by a cam ring (712), and having hooks of the needles opening facing away from said needle beds an inner of said needle beds possesses needles arranged on an inner surface, surrounding a cam ring (714), and having hooks of the needles opening facing an interior of said needle beds.

8. The machine as claimed in claim 6, wherein an outer of said needle beds (707) is frustoconical and an inner of said beds (705) is cylindrical.

9. The machine as claimed in claim 6, wherein an outer of said needle beds (701) is cylindrical and an inner of said beds (703) is frustoconical.

10. The machine as claimed in claim 6, wherein both said two needle beds (709–710) are frustoconical.

11. The machine as claimed in claim 6, wherein each of the two counter-rotating cam rings (21, 23; 712, 714) comprises a plurality of sets of cams (31, 33, etc.), each of which sets comprises one lowering cam (31A, 33A) and two lifting cams (31B, 31C; 33B, 33C) for lifting movements of two extents which are activated alternately.

12. The machine as claimed in claim 1, wherein a first thread guide device (431) is mounted in a seating for eccentric rotation in a plate (440) capable of rotating coaxially or otherwise about said outer device (411) and actuated to rotate during the formation of the body.

13. The machine as claimed in claim 1, wherein in order to vary the length of the stitches, at least one member having a bell cam (603) is provided which is movable coaxially to a counter-rotating devices (21, 23) of the cams, having at least one tappet member (610) which is axially movable and acts on a linkage (623, 616, 620, 622) for regulating the cams forming stitches on said counter-rotating devices.

14. The machine as claimed in claim 1 further comprising variable stitch lengths means for varying a length of stitches including at least one member (637) having an impelling channel (637A) and being displacable and acting on a frictioned slide (631A); said frictioned slide forming at least a lower active part (631A) of the variable stitch length means (31A), and a head (635) being controlled by sides of the impelling channel, said head passing through said impelling channel during the rotation of the associated counter-rotating device.

* * * * *